US007793524B2

(12) United States Patent
Hsiao

(10) Patent No.: US 7,793,524 B2
(45) Date of Patent: Sep. 14, 2010

(54) AIR CUSHION COMPRESSIVE STOCKING

(76) Inventor: Ming-Chi Hsiao, No. 481, Chang Tso 2 Lane, Chang Tso Vill., She Tou Hsiang, Changhua Hsien 511 (TW)

( * ) Notice: Subject to any disclaimer, the term of this patent is extended or adjusted under 35 U.S.C. 154(b) by 937 days.

(21) Appl. No.: 11/613,373

(22) Filed: Dec. 20, 2006

(65) Prior Publication Data

US 2008/0148783 A1 Jun. 26, 2008

(51) Int. Cl.
*A41B 11/00* (2006.01)

(52) U.S. Cl. ..... 66/178 R

(58) Field of Classification Search ..... 66/179, 66/178 R, 181, 182, 183, 178 A; 2/239–242
See application file for complete search history.

(56) References Cited

U.S. PATENT DOCUMENTS 2,814,807 A * 12/1957 Dollar ..... 2/239
3,189,919 A * 6/1965 Chase ..... 2/16
3,465,364 A * 9/1969 Edelson ..... 2/22
4,038,699 A * 8/1977 Burn ..... 2/239
4,669,126 A * 6/1987 Jones ..... 2/22
4,756,026 A * 7/1988 Pierce, Jr. ..... 2/16
4,870,708 A * 10/1989 Staley ..... 2/404
5,007,111 A * 4/1991 Adams ..... 2/22
5,040,245 A * 8/1991 Staley ..... 2/409
5,157,791 A * 10/1992 Woodson et al. ..... 2/239
5,226,194 A * 7/1993 Staley ..... 2/239
5,555,564 A * 9/1996 Welch ..... 2/239
5,581,817 A * 12/1996 Hicks ..... 2/239
D394,543 S * 5/1998 Lindaman ..... D2/936
D395,158 S * 6/1998 Lindaman ..... D2/986
6,332,224 B1 * 12/2001 Walker et al. ..... 2/239
6,729,164 B2 * 5/2004 Shibata ..... 66/178 R
7,552,483 B2 * 6/2009 Turner ..... 2/239

* cited by examiner

*Primary Examiner*—Danny Worrell

(57) ABSTRACT

A manufacturing process of air cushion sock includes mixing materials into elastic threads and cotton threads as sock material; knitting the sock material to form a sock body having a length about twice that of the air cushion sock; placing a shaped air cushion bag on one half portion of the sock body; folding the other half portion of the sock body onto one half portion of the sock body to cover the air cushion bag; turning over an opening of the sock body a predetermined length to position the air cushion bag; filling air into the air cushion bag; sealing the opening of the sock body by sewing to form the air cushion sock; and turning over the air cushion sock.

3 Claims, 7 Drawing Sheets

AIR CUSHION COMPRESSIVE STOCKING

BACKGROUND OF THE INVENTION

1. Field of the Invention

This invention relates to a manufacturing process for mixing several kinds of functional materials into elastic thread and cotton thread to make socks. Furthermore, after knitting by sock-making equipment, place an air cushion bag and make use of the packing steps of the sock body to fix the air cushion bag in position. Hence, when wearing the sock, the sock can absorb shock-harm caused by pressure and decrease energy consumption of human body as well as fatigue by the reverse bounce caused by the air cushion bag. Furthermore, the sock has other functions such as ventilation, deodorant, antiseptic, moisture-absorbing, sweat-draining, shock-absorbing, rubbing, softening and comforting.

2. Description of the Related Art

Normally, washcloth material will be knitted on sole of a stocking to thicken stocking sole for improving prevention effect. However, such process creating ineffective result, especially when receiving external impact, the thickened stocking cannot prevent the foot sole from being hurt.

SUMMARY OF THE INVENTION

The objective of the invention is to provide a method to produce air cushion compressive stocking. The manufacturing process is mixing several kinds of functional materials into elastic thread and cotton thread to make socks. Furthermore, after knitting by sock-making equipment, place an air cushion bag and make use of the packing steps of the sock body to fix the air cushion bag in position. Hence, when wearing the sock, the sock can absorb shock-harm caused by pressure and decrease energy consumption of human body as well as fatigue by the reverse bounce caused by the air cushion bag. Furthermore, the sock has other functions such as ventilation, deodorant, antiseptic, moisture-absorbing, sweat-draining, shock-absorbing, rubbing, softening and comforting.

The second objective of the invention is to provide an air cushion compressive stocking manufacturing method in which the material mixed into elastic thread and cotton thread is bamboo-carbon yarn.

The third objective of the invention is to provide an air cushion compressive stocking manufacturing method in which the material mixed into elastic thread and cotton thread is far infrared yarn.

The fourth objective of the invention is to provide an air cushion compressive stocking manufacturing method in which the material mixed into elastic thread and cotton thread is negative ion yarn.

The fifth objective of this invention is to provide an air cushion compressive stocking manufacturing method in which the material of air cushion bag is polyurethane.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENTS

Figure 1:
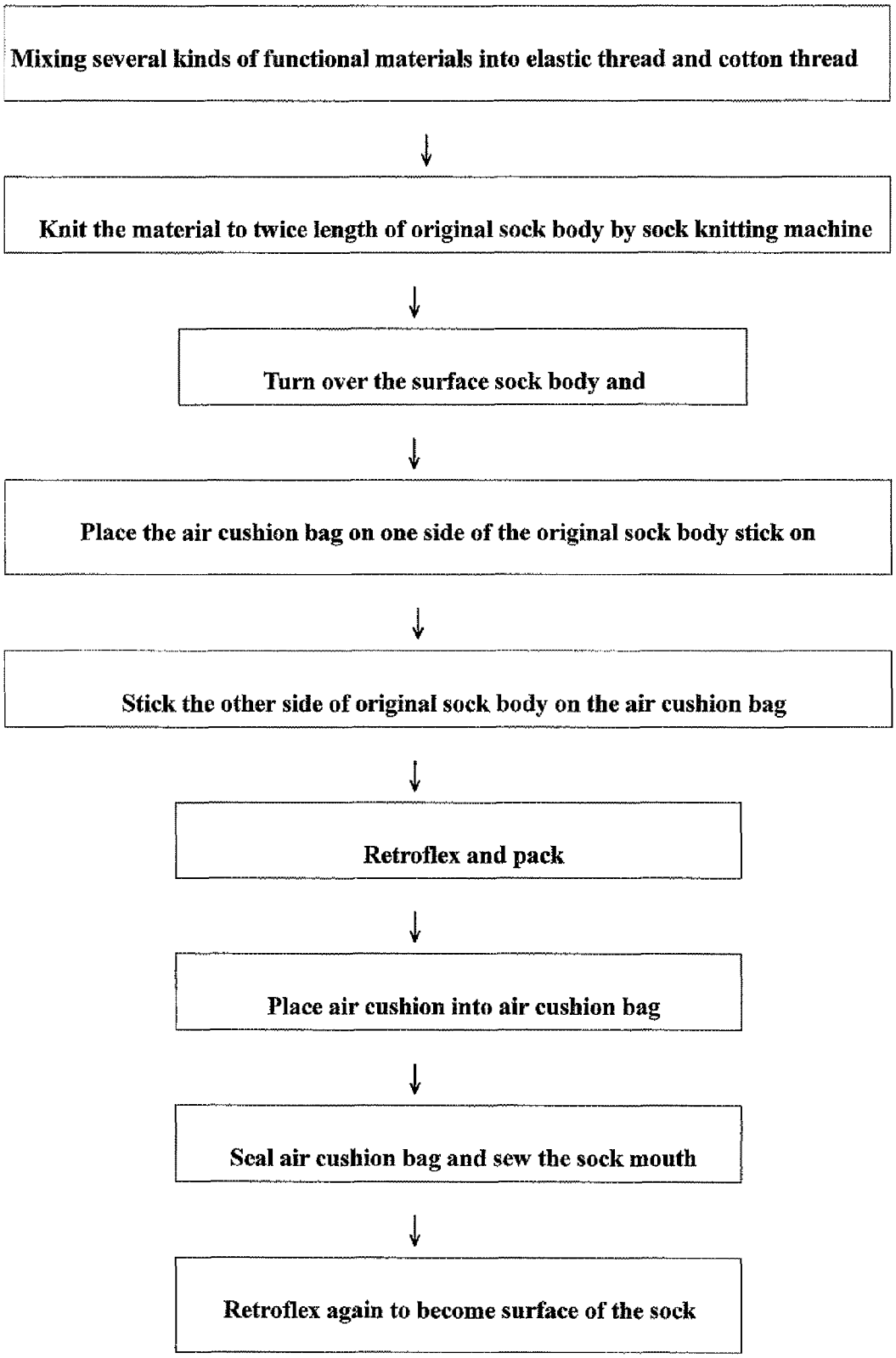
FIG. 1 is a schematic view of the manufacturing process of the present invention.
Figure 2:
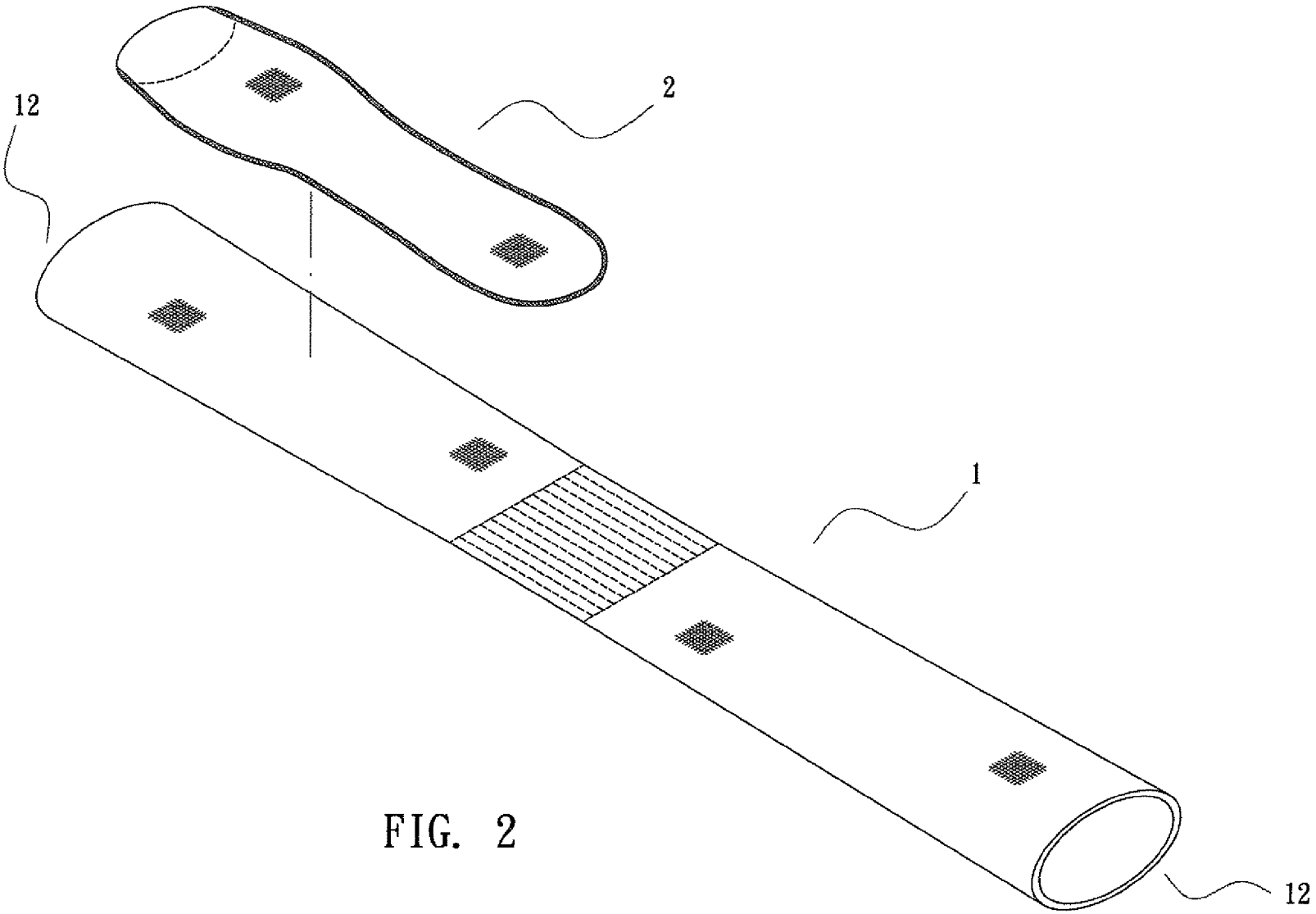
FIG. 2 is a schematic view of the manufacturing process of the present invention.
Figure 3:
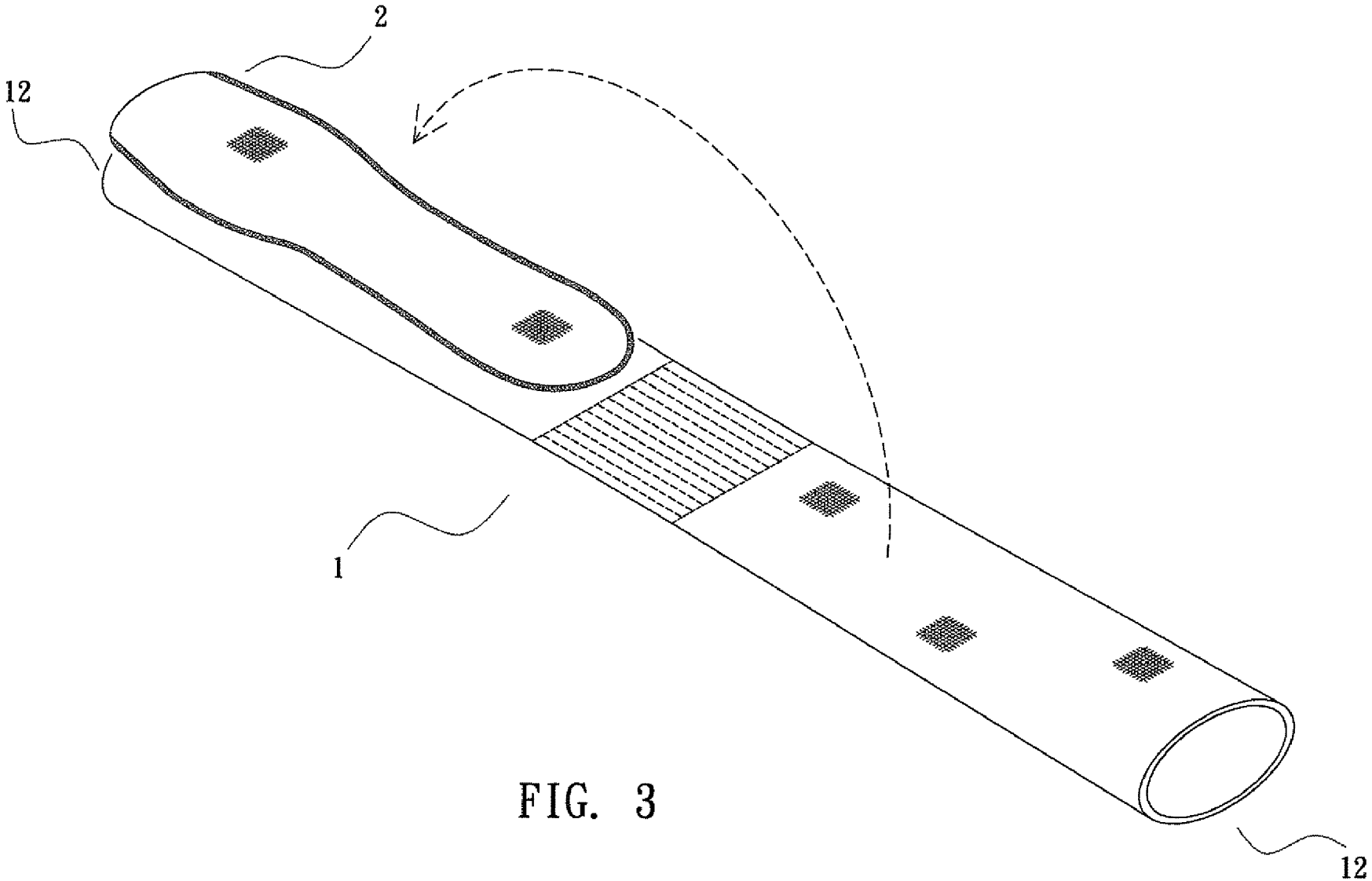
FIG. 3 is a schematic view of the manufacturing process of the present invention.
Figure 4:
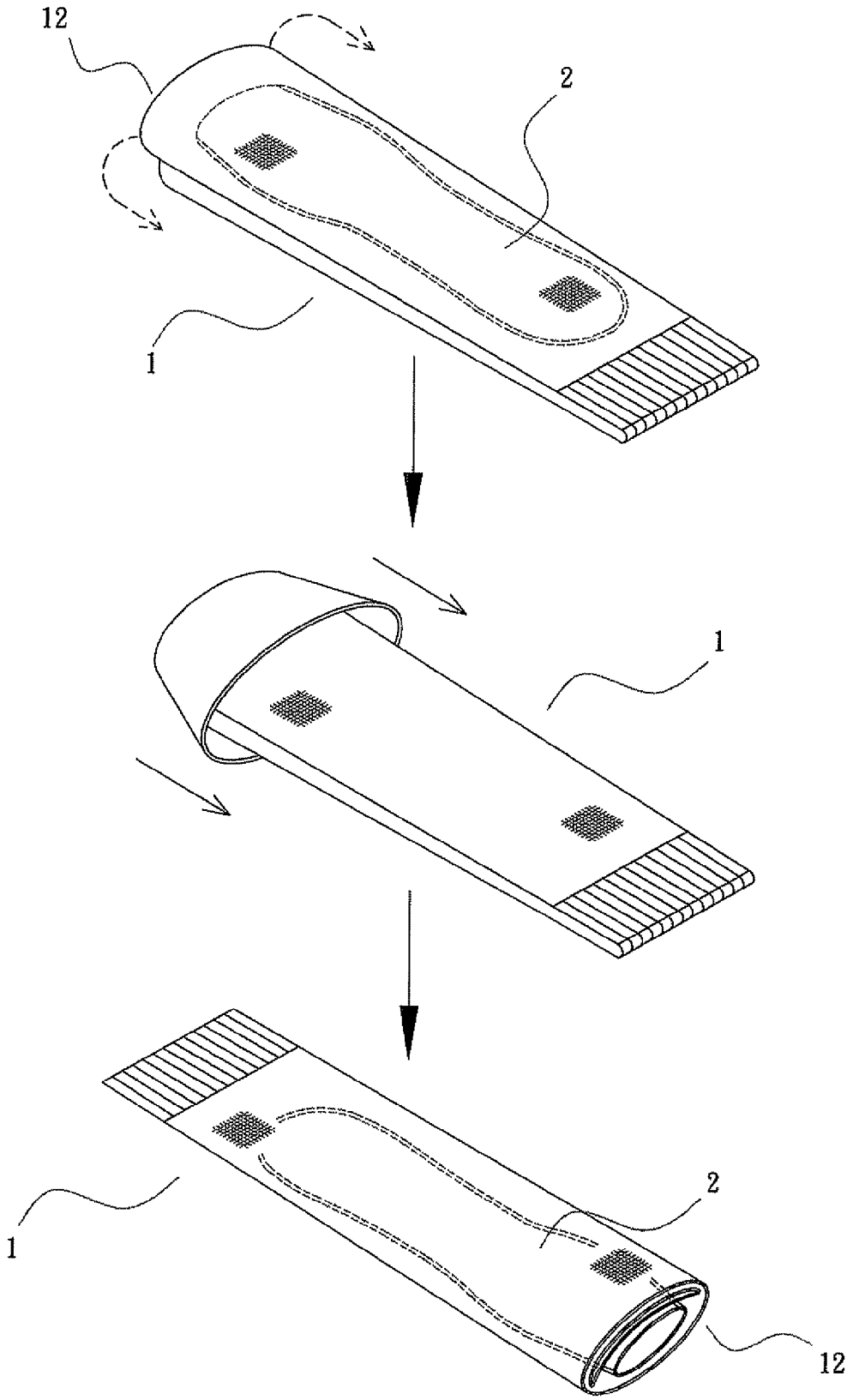
FIG. 4 is a schematic view of the manufacturing process of the present invention.
Figure 5:
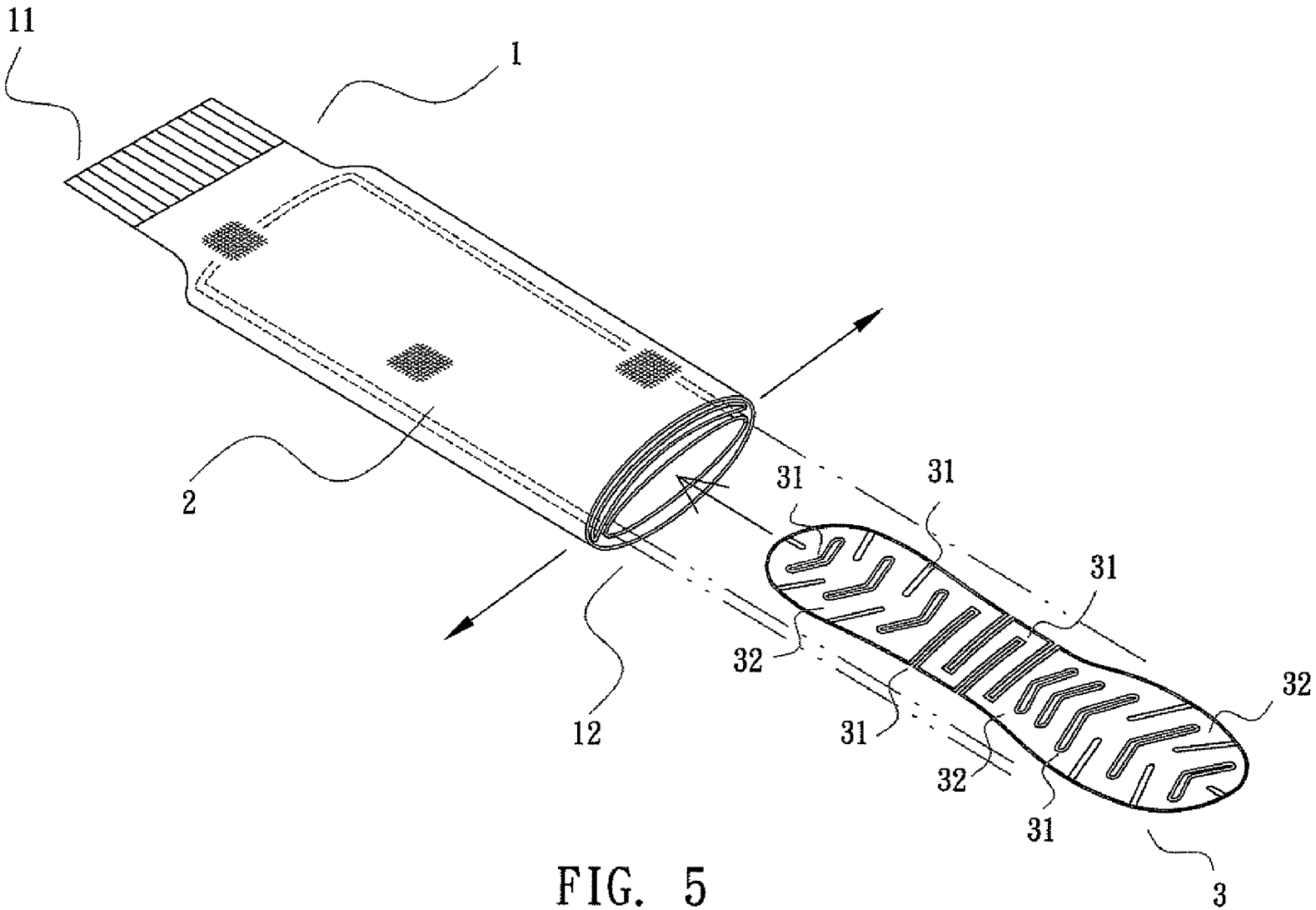
FIG. 5 is a schematic view of the manufacturing process of the present invention.
Figure 6:
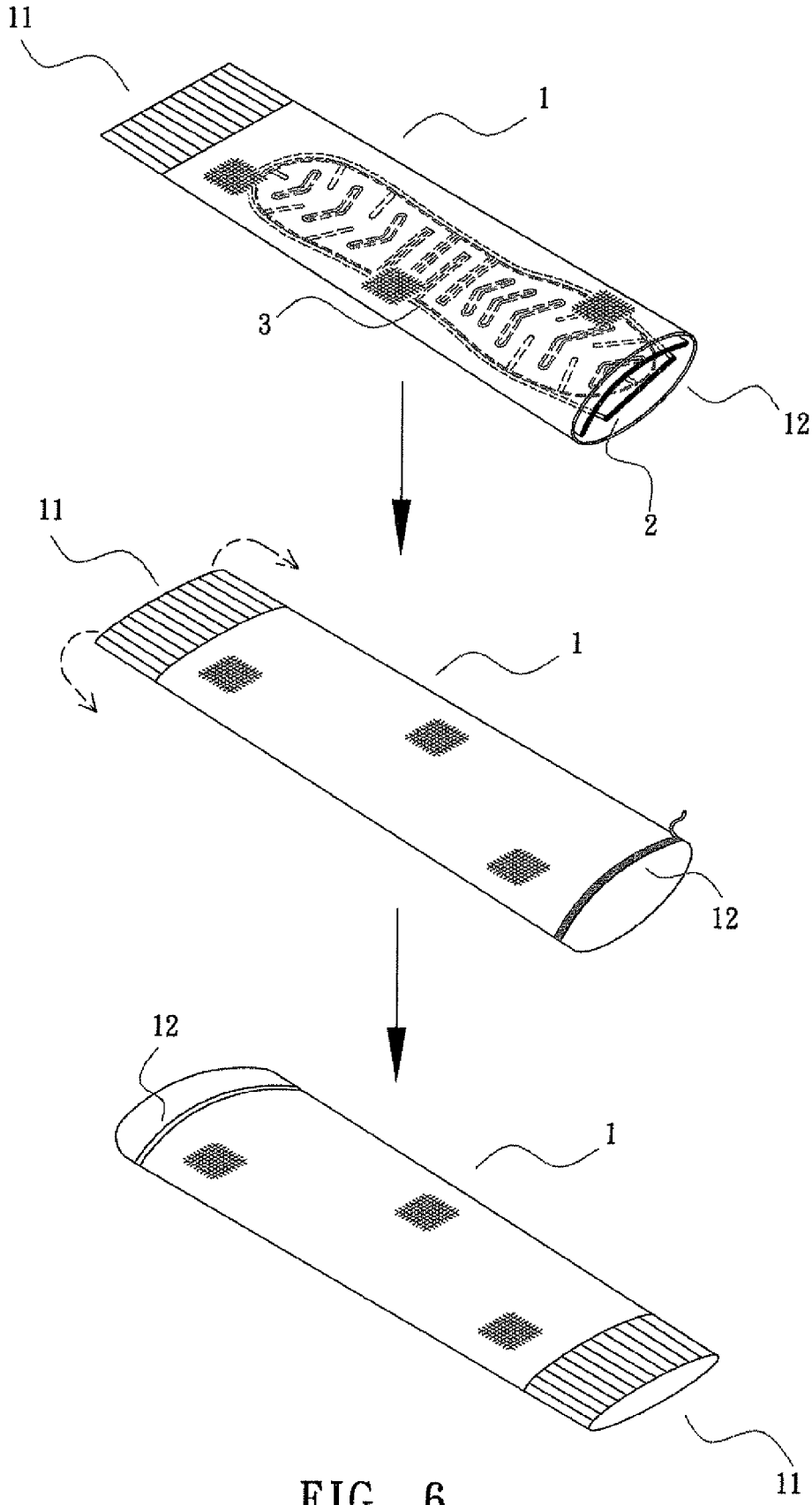
FIG. 6 is a schematic view of the manufacturing process of the present invention.

In the detailed description of the preferred embodiments, it should be noted that like elements are indicated by the same reference numerals throughout the disclosure.

Please refer to the detailed description of FIGS. 1, 2, 3, 4, 5 and 6. The air cushion compressive stocking manufacturing process of the invention is mixing several kinds of functional materials (ex. Bamboo carbon, far infrared, negative ion, etc.) into different ratio of elastic thread and cotton thread to make sock's material. Then, knit the material to twice length of original sock body 1 by sock knitting machine. Turn over the surface sock body 1 and retroflex, and place the shaped air cushion bag 2 on one side of the original sock body 1 (shown as FIG. 2). Double back the original sock body 1 (shown as FIG. 3) to fasten the air cushion bag 2 on position with two surfaces of the original sock body 1; then, retroflex as FIG. 4. Hence, the position of air cushion bag 2 will be between the first and the second layer counted from sole of sock body 1, and the end place between the second and the third layer is the sock mouth 1 for sole of the foot 4 to wear the sock. Then, place air cushion 3 into air cushion bag 2 (shown as FIG. 5) and seal the opening by sewing the mouth of double layers sock body 12. At last, retroflex the sock to complete the surface working of sock body 1 (shown as FIG. 6).

Many types of ribs 31 are set on the air cushion 3 in sock body 1 (as FIG. 5), ex. four pieces of horizontal ribs 31 on middle position, and eight pieces of V-shape ribs 31 on front and rear position, to form twisty air channel 32. Seal air cushion 3 after suitable amount of air filled in. When air cushion 3 is under pressure, air in air channel 32 will flow forward and backward slowly to create elasticity and act as a pressure buffer.

Figure 7:
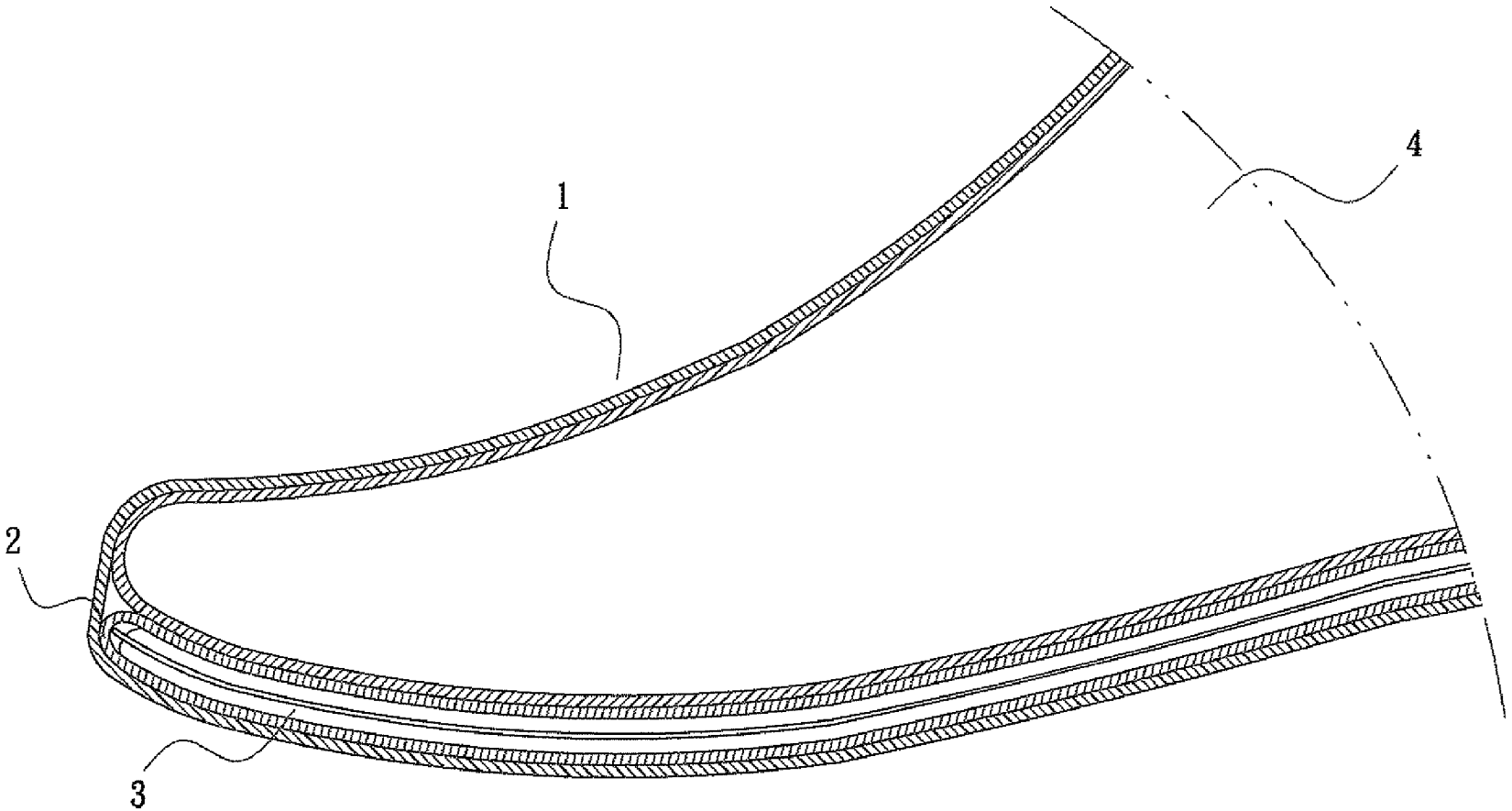
FIG. 7 is a drawing of wearing the stocking of the present invention.

When wearing on sole of the foot (as FIG. 7), the air cushion 3 will not only offer comfort feeling such as soft and perfectly fit as well as lightness, but also act as pressure buffer. When foot sole 4 steps down to press air cushion 3, air in air cushion 3 will follow the designed direction of air channel 32 to move slowly. It means that the heel will touch the ground first, when foot sole 4 steps down; then, as air in relative position of air cushion 3 is pressed, it will follow the twisty air channel 32 to move forward. When middle part of the foot sole 4 touch the ground, air in the air cushion 3 will follow the twisty air channel 32 to move forward and backward. When foot sole 4 steps down till tiptoe touching the ground; then, as air in relative position of air cushion 3 is pressed, it will follow the twisty air channel 32 to move backward. A treading action of "one step" is completed as above-mentioned process. After that, when foot sole 4 is lift to walk forward, no pressure is delivered to air cushion 3 and air in air cushion 3 will move back to original place. Left foot and right foot will act downward and upward alternately, and air in air cushion 3 will move continuously to create elasticity for preventing shock and releasing pressure. Furthermore, while receiving external impact, since air cushion 3 is set in sock body 1', sock body 1' has features as follows:

1. When receive pressure, it can absorb shock and pressure to reduce harm caused by shock and pressure.
2. It can scatter pressure effect to avoid harm caused by concentrated pressure.
3. It will produce reverse elasticity when receiving pressure; hence, it can reduce energy consumption of human body and relax fatigue to improve activity effect, when human proceeds long-term and continuous action.
4. Moreover, air cushion 3 is located in the mezzanine layer of sock body 1' and has four pieces of horizontal rib 31 and eight pieces of V-shape rib 31; the designed ventilating cut between each rib creates air convection effect to conduce excellent ventilation effect of air cushion 3.

What is more, several kinds of functional material (ex. Bamboo carbon, far infrared, negative ion, etc.) mixed in the sock body 1' induces deodorant, antiseptic, moisture-absorbing, sweat-draining, shock-absorbing, rubbing, softening and comforting effects and then achieves the purpose of health care. While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. A manufacturing process of an air cushion sock, comprising the steps of:

mixing a plurality of materials into elastic threads and cotton threads to be employed as a sock material;

knitting the sock material to form a sock body having a length about twice that of the air cushion sock;

placing a shaped air cushion bag on one half portion of the sock body;

folding the other half portion of the sock body onto one half portion of the sock body to cover the air cushion bag;

turning over an opening of the sock body a predetermined length to position the air cushion bag;

filling air into the air cushion bag;

sealing the opening of the sock body by sewing to form the air cushion sock; and turning over the air cushion sock.

2. The manufacturing process of an air cushion sock as claimed in claim 1, wherein a first one of the materials mixed into the elastic threads and the cotton threads is bamboo-carbon yarn.

3. The manufacturing process of an air cushion sock as claimed in claim 1, wherein a second one of the materials mixed into the elastic threads and the cotton threads is negative ion yarn.

* * * * *